United States Patent [19]

Wolfe et al.

[11] 4,373,222

[45] Feb. 15, 1983

[54] PROSTHETIC BENCH

[75] Inventors: Richard M. Wolfe; Katharine N. Dixon, both of Columbus, Ohio

[73] Assignee: Enhancement Systems, Inc., Los Angeles, Calif.

[21] Appl. No.: 115,951

[22] Filed: Jan. 28, 1980

[51] Int. Cl.[3] ..... A61G 7/06; A47C 11/00; A47C 20/04

[52] U.S. Cl. ..... 5/431; 5/443; 5/445; 128/70; 269/328

[58] Field of Search ..... 5/431–435, 5/443, 444–447, 465, 479, 508, 445; 269/322–328; 128/83, 70

[56] References Cited

U.S. PATENT DOCUMENTS

| | | | |
|---|---|---|---|
| 885,243 | 4/1908 | Haas | 5/431 |
| 2,258,782 | 10/1941 | McKean | 269/328 |
| 2,291,233 | 7/1942 | Karlik | 5/93 |
| 2,766,463 | 10/1956 | Bendersky | 5/433 |
| 3,042,025 | 7/1962 | Jackson | 128/33 |
| 3,310,817 | 3/1967 | Harding | 5/445 |
| 3,318,596 | 5/1967 | Herzog | 269/328 |
| 3,381,684 | 5/1968 | Anderson | 269/328 |
| 3,795,018 | 3/1974 | Broaded | 269/324 |
| 3,818,091 | 5/1974 | Metzger | 269/322 |
| 3,833,211 | 9/1974 | Mueller et al. | 269/328 |
| 3,896,787 | 7/1975 | Withers | 269/328 |
| 4,122,567 | 10/1978 | Hanson | 5/448 |
| 4,210,317 | 7/1980 | Spann et al. | 269/328 |
| 4,225,127 | 9/1980 | Strutton | 269/328 |

FOREIGN PATENT DOCUMENTS

| | | | |
|---|---|---|---|
| 699718 | 6/1953 | United Kingdom | 269/328 |

*Primary Examiner*—Alexander Grosz
*Attorney, Agent, or Firm*—Bruce A. Jagger

[57] ABSTRACT

A bench for supporting two persons engaged in sexual intercourse including a narrow platform for supporting the male in a supine position, arm and leg cradles for supporting the male in a spread eagle position, and a frame position to provide hand holds for a female standing straddle of the narrow platform.

7 Claims, 7 Drawing Figures

Figure 1:
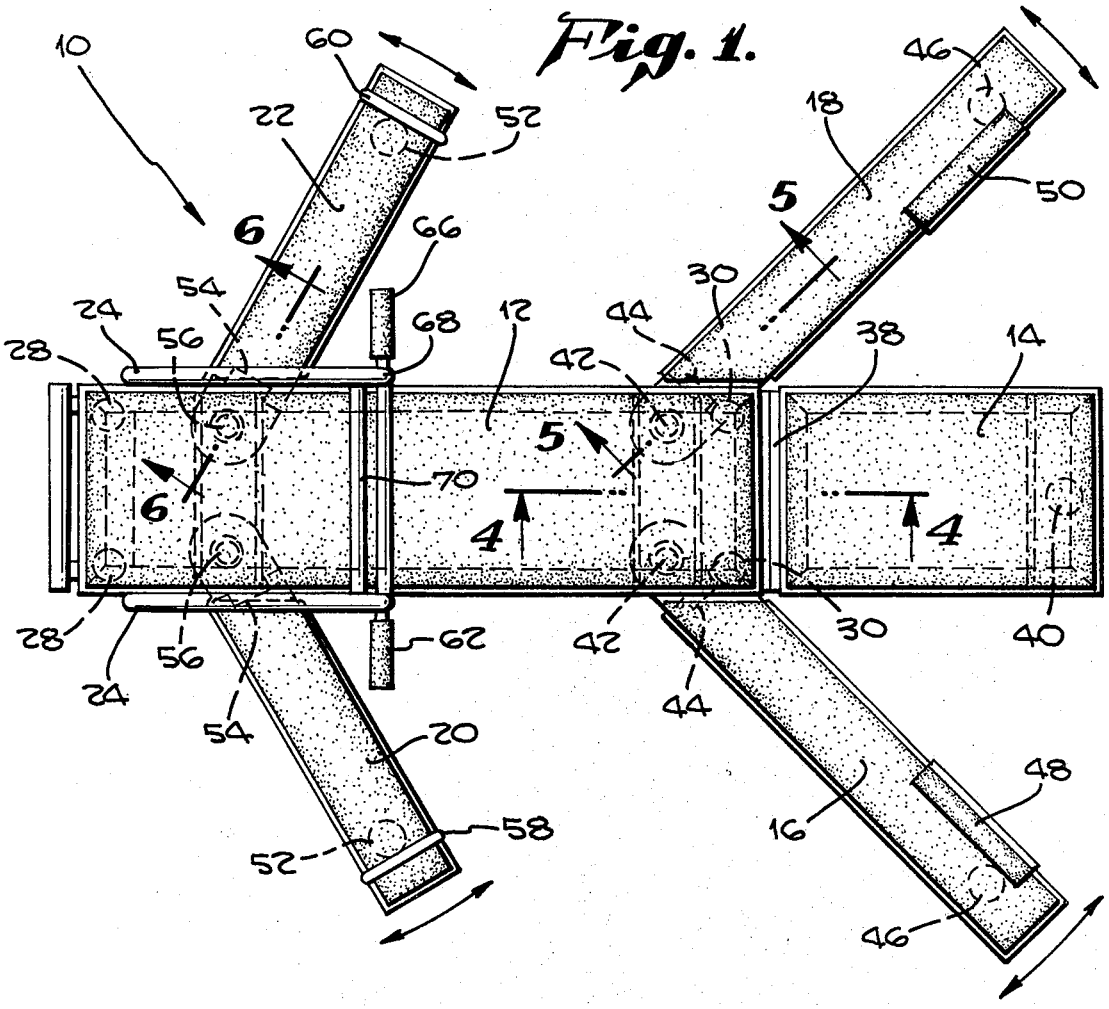

10
60
52
22
6
66
54
24
56
28
68
12
44
42
30
5
18
46
50
38
14
70
4
62
20
58
48
16

70
10
24
62
68
64
7
20
58
12
14
48
28
54
52
44
38
30
16
26
46
40

PROSTHETIC BENCH

This invention relates to a bench and, more particularly to a bench for supporting two persons engaging in sexual intercourse with the female in the superior position.

Previously, considerable difficulty has been experienced in engaging in sexual intercourse where certain adverse psychological and physiological factors were involved. Where the male suffers from certain physical disabilities such as diseased or damaged heart or respiratory systems or paralysis or impairment of the lower limbs sexual intercourse has been very difficult and sometimes dangerous. Some females have suffered from sexual dysfunction or dispareunia. Frigidity and impotence not due to physiological reasons have occasionaly prevented the full enjoyment of sexual intercourse.

A bench according to the present invention provides a means of overcoming some of the difficulties which have previously been experienced in sexual intercourse.

According to the present invention the male partner is supported in the face upwardly or supine position on a relatively narrow bench which is adjustably positioned above the floor or other substrate so that the female partner can stradle the male in the pelvic area while standing flat footed on the floor with the knees bent. In this position the female assumes the active role and the male is essentially passive. The structure of the bench provides a plurality of positions for the male's lower limbs including an extension of the bench which, if desired, may extend in the plane of the bench or may fold hingedly downwardly so as to support the lower portion of the legs in a lowered position. Also, leg cradles may be provided which angle outwardly and are adjustable in both the vertical and horizontal planes to support the male partners legs in a spread eagle configuration. Arm cradles for the male may also be provided if desired. The arm cradles may also be adjustable in both the horizontal and vertical planes. A frame is provided over the bench positioned so as to be readily grasped by at least the female partner.

Many of the advantages of the present invention are due to the fact that the female partner is able to position her feet below the pelvic area of the male. The structure which permits this positioning within the strength capabilities of the female includes a frame structure positioned so that the hands or arms of the female can be supported on the frame with the arms outstretched in a horizontal position when straddling the pelvis of the male. The frame is preferably adjustable so as to provide this approximate position. Alternate accessory handles positioned to provide hand holds at other locations or foot rungs for the alternate foot placement of the female may be provided on the frame if desired.

The bench and cradles are preferably padded and may be contured for greater comfort if desired. The bench may conveniently be constructed so that it is readily folded or disassembled to permit easy storage.

Figure 2:
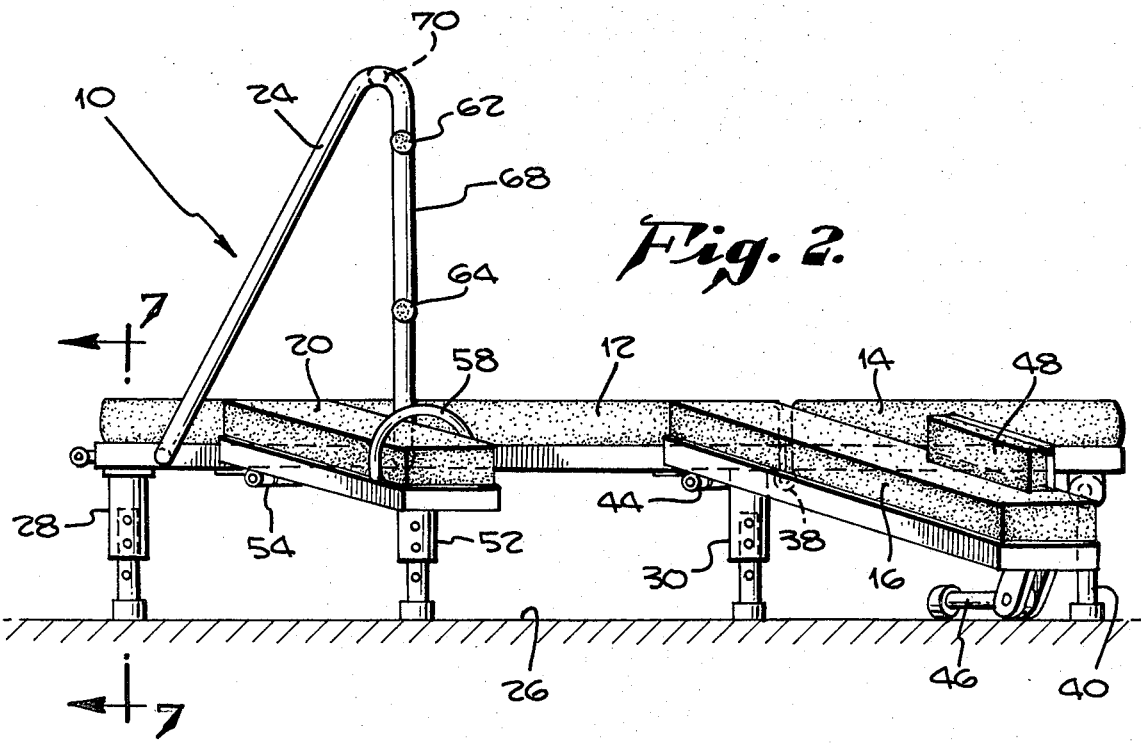
Figure 3:
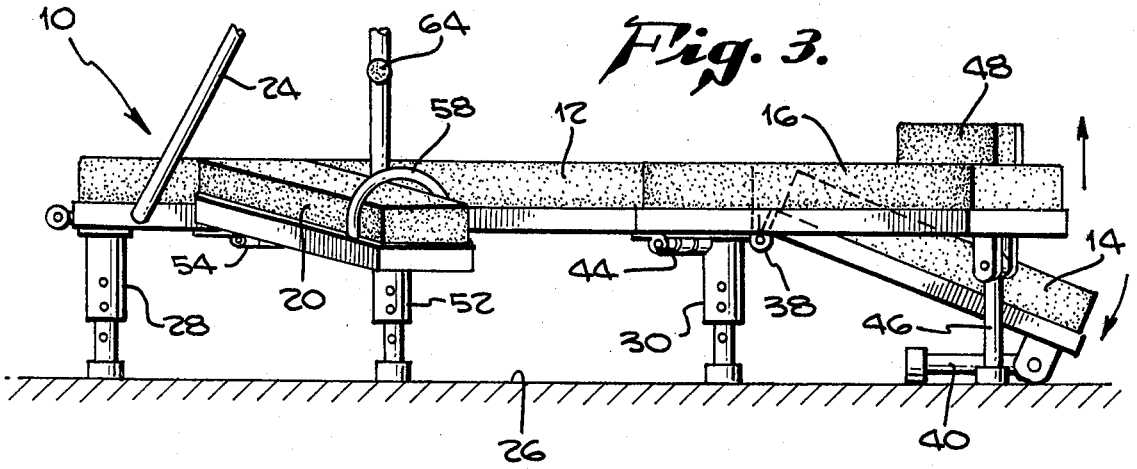
Figure 4:
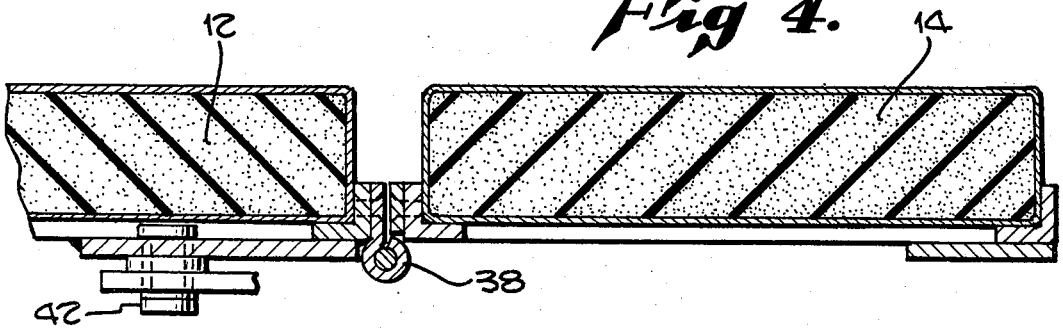
Figure 5:
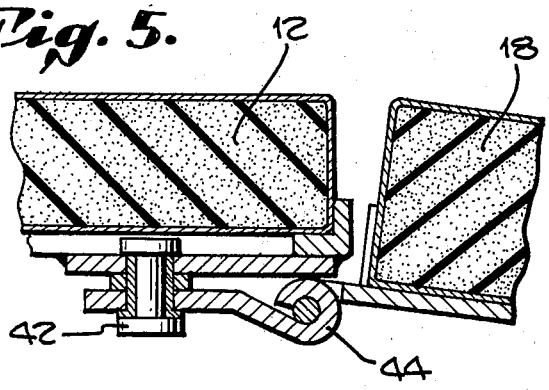
Figure 6:
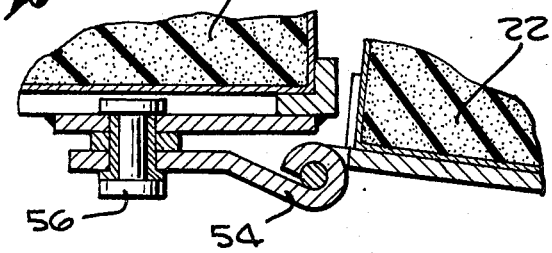

Referring particularly to the drawings for the purposes of illustration and not limitation there is illustrated:

FIG. 1, a plan view of an embodiment of a bench according to the present invention;

FIG. 2, a side elevational view of the bench illustrated in FIG. 1 with the leg cradles extended anngularly downwardly;

FIG. 3, a view similar to FIG. 2, showing the end panel extending angularly downwardly;

FIG. 4, a partial cross-sectional view taken along line 4—4 in FIG. 1;

FIG. 5, a partial cross-sectional view taken along line 5—5 in FIG. 1;

FIG. 6, a partial cross-sectional view taken along line 6—6 in FIG. 1; and

Figure 7:
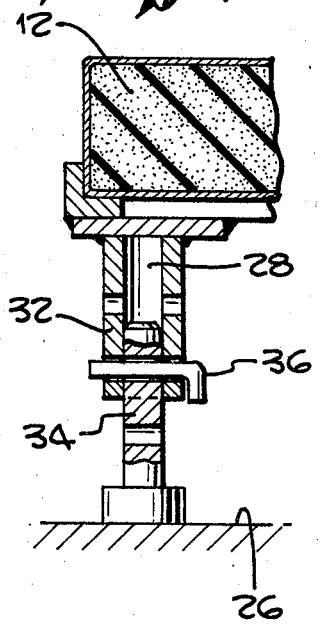

FIG. 7, a partial cross-sectional view taken along line 7—7 in FIG. 2.

Referring particularly to the drawings there is illustrated generally at 10 a bench according to the present invention which includes a padded main panel 12 and a padded end panel 14 hingedly attached to main panel 12 and extending longitudinally therefrom. First and second leg cradles 16 and 18, respectively, project angularly outwardly from main panel 12 at about the pelvic area of a person located in the supine position on main panel 12. First and second arm cradles 20 and 22, respectively, project angularly outwardly from main panel 12 at about the location of the arms of a person mounted in the supine position on main panel 12. Frame 24 is mounted over main panel 12. Frame 24 provides hand holds which are positioned to be readily grasped by the horizontally extended arms of a person straddling main panel 12.

Main panel 12 is supported above a floor or other substrate 26 by means of telescoping leg illustrated particularly in FIGS. 2,3 and 7. Four telescoping legs support main panel 12, of which first and second telescoping legs 28 and 30, respectively, are illustrated. First telescoping leg 28 includes sleeve 32 which is adapted to receive axially therein post 34. First telescoping leg 28 is secured at a particular location by means of pin 36 which is inserted through mating bores in sleeve 32 and post 34.

End panel 14 is hingably mounted to main panel 12 through panel hinges 38. The outer end of end panel 14 is supported by folding leg 40. In its extended configuration folding leg 40 supports end panel 14 as shown particularly in FIG. 2. In this configuration end panel 14 extends in about the same plane as main panel 12. In the folded configuration folding leg 40 permits end panel 14 to assume the position illustrated particularly in FIG. 3. In this configuration the lower extremities of a person who is mounted in the supine position on panel 12 are allowed to project angularly downwardly.

Leg cradles 16 and 18, respectively, are mounted to main panel 12 for movement in both the vertical and horizontal planes. Movement in the horizontal plane is permitted by pivotal connection 42. Movement in the vertical plane is accomodated by leg cradle hinge 44, see particularly FIG. 5. Leg cradles 16 and 18 are supported at their respective outer ends by folding legs 46 as illustrated particularly in FIGS. 2 and 3. In the extended position legs 46 support the leg cradles in about the same plane as main panel 12. In the collasped configuration legs 46 permit the leg cradles to angle downwardly. Ankle restraining blocks 48 and 50, respectively, are mounted on the inwardly disposed sides of leg cradles 16 and 18 so as to assist the supine person in maintaining a spread eagle position.

Arm cradles 20 and 22 are mounted for movement in both the vertical and horizontal planes by means which are similar to those associated with leg cradles 16 and 18 and include telescoping leg 52, arm cradle hinge 54 and pivotal connection 56. Movement in the horizontal plane is provided by pivotal connection 56 and movement in the vertical plane is provided by arm cradle hinge 54. Telescoping leg 52 supports the outer end of the arm cradle. Hand holds 58 and 60, respectively, are provided at the outer ends of arm cradles 20 and 22. Hand holds 58 and 60 are conveniently located for grasping by a person in the supine position on main panel 12.

Handles 62,64 and 66 are adjustably mounted on frame 24. Handles 62,64 and 66 are provided in sets of two with the handle opposite handle 64 not being shown. These handles provide a convenient place for grasping by a person standing straddle of main panel 12. The handles are adjustable along the length of upright 68 so as to permit adjustment to fit individual requirements. Cross bar 70 also serves as a convenient grasping location.

Pivotal connections 42 and 56 are readily demountable to permit the storage or use of bench 10 without one or both of the leg and arm cradles. Frame 24 may also be readily removable from main panel 12.

In general, the platform which is inclusive of main panel 12 is supported so that it extends generally horizontally. The width of the platform is approximately equal to the width of the hips of the human body. The bench is of such a length that it will support the supine form of an adult male human being with his pelvis located at such a location that his legs are easily positionable in leg cradles 16 and 18. The adjustment of telescoping legs 28 and 30 is determined by the length of the female legs and is adjusted so as to permit ease of movement.

What has been described are preferred embodiments in which modifications and changes may be made without departing from the spirit and scope of the accompanying claims.

What is claimed is:

1. A bench adapted to be used for sexual activity comprising:

platform means for supporting a human body in the supine position including an elongated surface adapted to extend generally horizontally, an extension of said elongated surface projecting from one end thereof and being angularly downwardly adjustable relative to said elongated surface to support the lower portion of the legs of said human body in a lowered position, leg cradle means projecting angularly outwardly from said surface for adjustably supporting the lower extremities of said human body in a spread eagle position, said leg cradle means being adjustable relative to said elongated surface, arm cradle means projecting angularly outwardly from said surface for cradling the arms of said human body, said arm cradle means being angularly adjustable relative to said elongated surface; and frame means extending upwardly over said surface for grasping by the hands of a person using said bench.

2. A bench of claim 1 wherein said surface has a width approximately equal to the width of the hips of said human body.

3. A bench of claim 1 wherein said surface is adapted to being supported by a substrate, and said platform means includes means for adjusting the height of said surface above said substrate.

4. A bench of claim 1 wherein said frame means is adjustable relative to said elongated surface.

5. A bench of claim 1 wherein said arm cradle means includes hand hold elements thereon.

6. A bench of claim 1 wherein said leg cradle means includes leg blocking elements to facilitate maintaining the legs of said human body in the desired position on said leg cradle means.

7. A bench of claim 1 wherein said elongated surface is contoured to fit said human body.

* * * * *